US005081696A

United States Patent [19]

Beck

[11] Patent Number: 5,081,696

[45] Date of Patent: Jan. 14, 1992

[54] ELECTRICALLY GROUNDED WATER HEATER

[75] Inventor: David H. Beck, Grand Rapids, Mich.

[73] Assignee: Bradford-White Corporation, Middleville, Mich.

[21] Appl. No.: 645,833

[22] Filed: Jan. 25, 1991

[51] Int. Cl.[5] ..... H05K 5/02

[52] U.S. Cl. ..... 392/449; 219/541; 392/451; 439/95; 439/106; 439/816; 174/51; 174/5 SG

[58] Field of Search ..... 392/449, 451–452, 392/457; 439/95, 92, 96, 101–108, 816, 828, 834; 174/35 GC, 5 SG, 51, 52.1; 219/541, 542, 526, 478; 220/433, 432, 690

[56] References Cited

U.S. PATENT DOCUMENTS 3,122,604 2/1964 Cook et al. ..... 174/51
3,627,900 12/1971 Robinson ..... 174/51
3,680,031 7/1972 Schumacher ..... 439/95

FOREIGN PATENT DOCUMENTS 3436119 4/1986 Fed. Rep. of Germany ..... 439/95

*Primary Examiner*—Bruce A. Reynolds
*Assistant Examiner*—John A. Jeffery
*Attorney, Agent, or Firm*—Austin R. Miller

[57] ABSTRACT

A water heater having an electrically grounded water tank including an electrically conductive portion, a water tank inlet and outlet connected to deliver water to and from the water tank, a heater connected to the tank for heating water in the tank, a control for controlling the application of heat to the water, an electrically grounded outer jacket surrounding the water tank, a bottom member electrically grounded to the outer jacket, and a spring urged electrical bonding clip secured to and electrically connected to the bottom member and directly electrically engaging the water tank electrically conductive portion.

A method of producing a water heater which includes a water tank having an electrical connecting portion and a grounded bottom member including the steps of providing an electrically conductive grounding clip on the bottom member, physically and electrically engaging the water tank electrical connecting portion with the grounding clip to thereby position the water tank and the bottom member into position relative to one another in establishing a grounding connection therebetween and positioning an outer jacket around the water tank and into physical and electrical engagement with the bottom pan to thereby provide a space between the water tank and the jacket and grounding the tank to the jacket through the bottom member.

20 Claims, 5 Drawing Sheets

FIG. 2
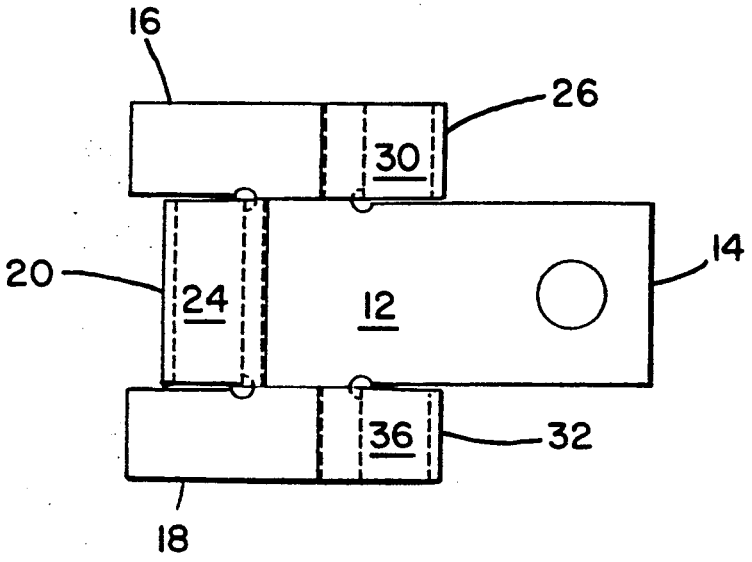
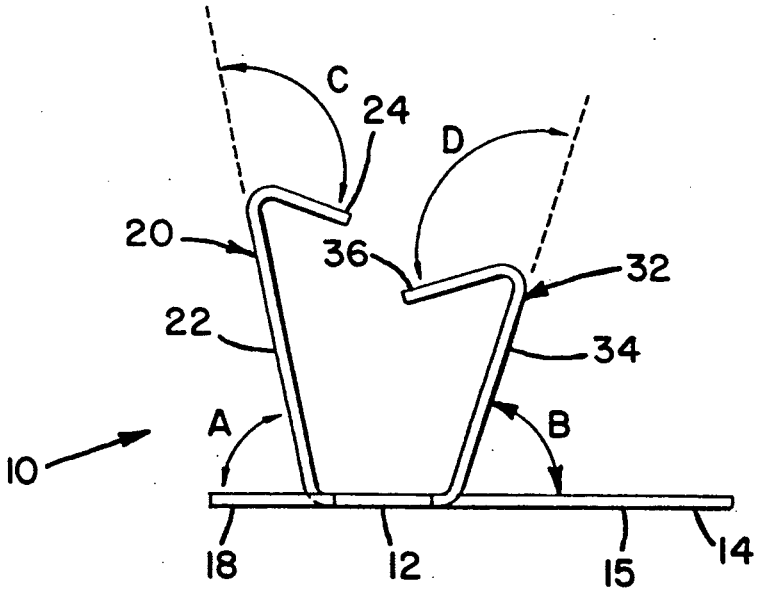
FIG. 3

ELECTRICALLY GROUNDED WATER HEATER

BACKGROUND OF THE INVENTION

The present invention relates to an electrically grounded heater, particularly to a water heater with an electrically grounded tank and a novel form of spring - urged, tightly engaged electrical grounding clip.

FIELD OF THE INVENTION

It is highly desirable especially in electrically energized water heaters to provide a means for insuring that the water heater tank is properly grounded. The importance of reliable grounding is well known for safety reasons.

Prior means for grounding water heaters, especially means for grounding the electrical controls of a water heater have been either inadequate or cumbersome, especially for a task having such safety importance. Conventional water heaters typically rely on a wire connection between a thermostat and/or electrical control mounted on a water tank connected to the outer jacket. The outer jacket/wire connection is typically achieved by wrapping the end of the wire around a screw, which is rotated or screwed into a hole in the jacket. While this connection is theoretically relatively easy to reliably install, production realities are far different. Water heaters are often mass produced on moving assembly lines. It is sometimes necessary to dedicate a person working on an assembly line to insure that the proper wire connection is made.

While the resulting electrical grounding connection is often

OBJECTS OF THE INVENTION

It is an object of the present invention to provide a means for easily and reliably grounding a water heater.

It is another object of the present invention to provide a means for grounding a water heater which is easy to install and resists becoming disconnected after manufacture.

It is an important object of the present invention to provide a means for grounding the outer jacket of the water heater without utilizing extraneous wires or screws and without requiring drilling and connection of parts by additional assembly line personnel.

Other objects and advantages of the present invention will become apparent to those skilled in the art from the drawings, the detailed description of preferred embodiments and the appended claims.

SUMMARY OF THE INVENTION

The present invention provides a water heater with an electrically grounded tank and jacket. The water heater typically includes a bottom pan and a water tank having a lower wall portion positioned on the bottom pan. Heating means, often electrical, are connected to the water tank for heating water in the tank and electrical control means are connected to the heating means for controlling application of heat to water in the water tank. An outer jacket surrounds the water tank and is connected to the bottom pan. Insulation is introduced between the tank and the jacket to provide thermal efficiency. Grounding means in the form of a bonding clip including spring - urged prongs extends from the bottom pan and grippingly engages opposed surfaces of the water tank lower wall. The bonding clip preferably includes three or more spring - urged prongs extending from the bottom pan and engaging opposite surfaces of the water tank lower wall.

According to the present invention the electrical bonding clip bonds the water tank to the bottom pan. Since the bottom pan is already grounded to the jacket and the jacket to the grounded top pan grounding of the water tank is assured.

In a preferred form the grounding clip or bonding clip of this invention includes a base plate, a first prong including a first leg extending upwardly at an angle from the base plate and having a first tip portion extending downwardly at an angle to the first leg. The clip further includes at least a second prong including a second leg extending upwardly at an angle from the base plate opposite the angle of the first prong with a second tip extending downwardly at an angle to the second prong. The base plate also has at least one foot extending outwardly therefrom.

BRIEF DESCRIPTION OF THE DRAWINGS

FIG. 2 is a top plan view of the bonding clip shown in FIG. 1.

FIG. 3 is a side elevational view of the bonding clip shown in FIG. 1.

DETAILED DESCRIPTION OF THE INVENTION

Figure 1:
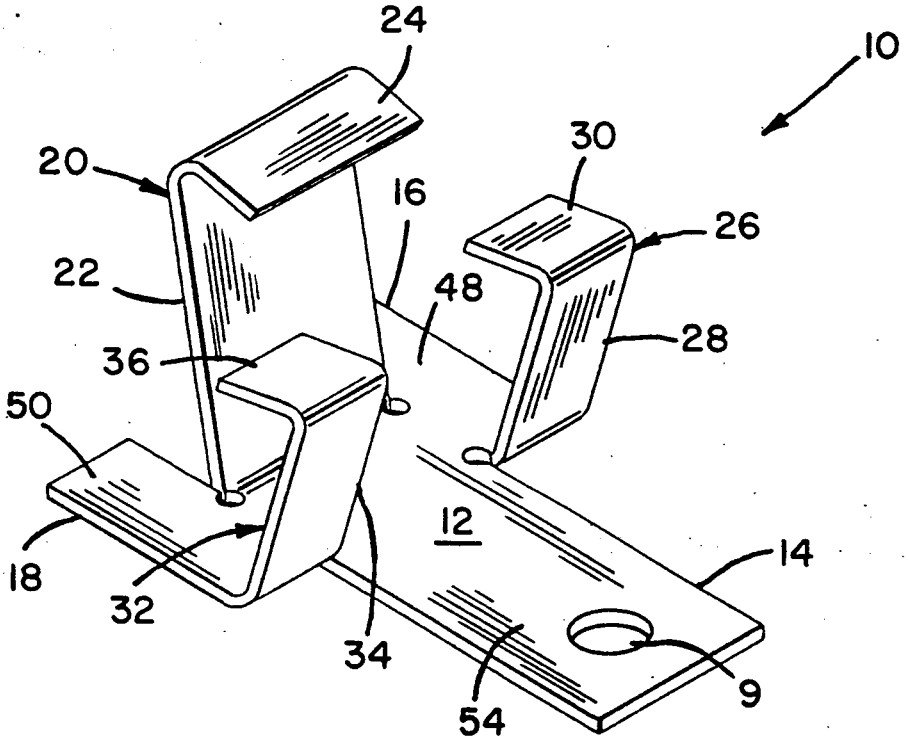
FIG. 1 is a perspective view of one embodiment of an electrical bonding clip of the invention.

It will be appreciated that the following description is intended to refer to the specific embodiment of the invention selected for illustration in the drawings and is not intended to define or limit the scope of this invention, which is defined in the appended claims.

Turning now to the specific form of the invention illustrated in the drawings and referring particularly to FIGS. 1 and 2, the number 10 designates an electrical bonding clip in accordance with the invention. Clip 10 is intended to be generally horizontally oriented and includes a base plate 12 provided with a foot portion 14 extending substantially horizontally outwardly in one direction. Foot portion 14 is provided with a drill hole 9 to facilitate fastening or welding to another water heater component, as will further become apparent hereinafter. Base plate 12 also includes foot portions 16 and 18 extending outwardly from base plate 12 in a direction opposite foot portion 14. Foot portion 14 has an upper surface 54 and foot portions 16 and 18 have upper surfaces 48 and 50, respectively, lying in the same plane.

A first prong 20 of spring metal extends angularly upwardly from base plate 12 and includes an outwardly inclined yieldable leg 22 and an inclined contact 24 bent back upon and extending angularly downwardly and inwardly toward the middle of the bonding clip from the prong leg 22. A second outwardly inclined yieldable prong leg 26 extends upwardly at an angle from base 12 and away from first prong 20, and includes a second leg portion 28 and a second contact tip 30 which is oriented inwardly toward the first contact 24. Similarly, a third spring metal prong 32, generally parallel to but spaced from the second prong 26, extends upwardly at an outwardly inclined angle from base 12 and includes a third leg 34 and third contact 36 which is spaced from second contact 30 but is also spaced from and oriented toward the first 24.

Referring to FIG. 3 of the drawings, first prong 20 and third prong 34 are shown extending upwardly from base plate 12. First leg 22 extends upwardly and outwardly at an angle "A" from base plate 12 which may, for example, be about 78°. Third leg 34 extends upwardly and outwardly away from first leg 22 at an angle "B" which may, for example, be about 73°.

Contact 24 of leg 22 extends inwardly toward the center of the clip at an angle from leg 22 as shown by the angle "C", which may, for example, be about 122°. Similarly, contact tip 36 extends inwardly toward the center of the clip from third leg 34 at an angle represented by the angle "D". Angle "D" may, for example, be about 124°. Although not shown in FIG. 3 because it is behind leg 34 and contact 36, second leg 28 (FIG. 1) extends upwardly from base plate 12 at an angle similar to angle "B" and contact 30 extends inwardly from second leg 28 at an angle similar to angle "D".

Figure 4:
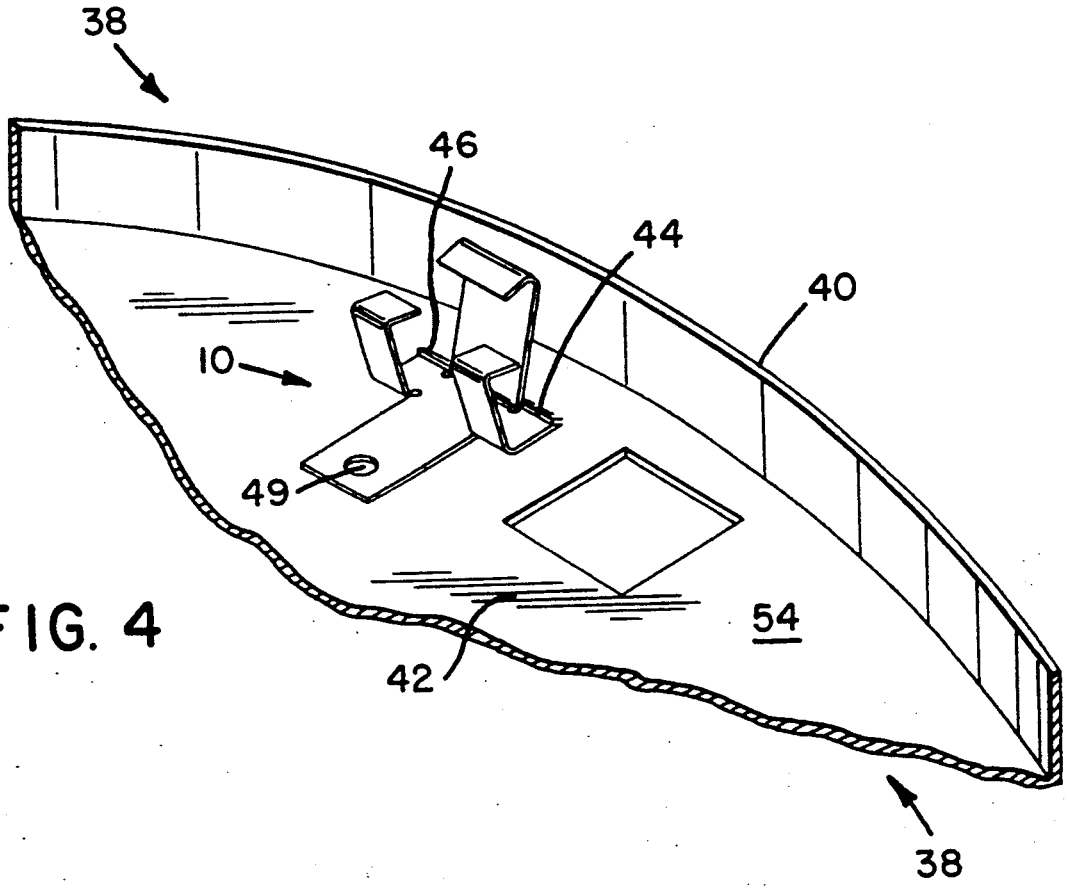
FIG. 4 is a perspective view of the bonding clip shown in FIG. 1, mounted on the top surface of a bottom pan of a water heater.
Figure 5:
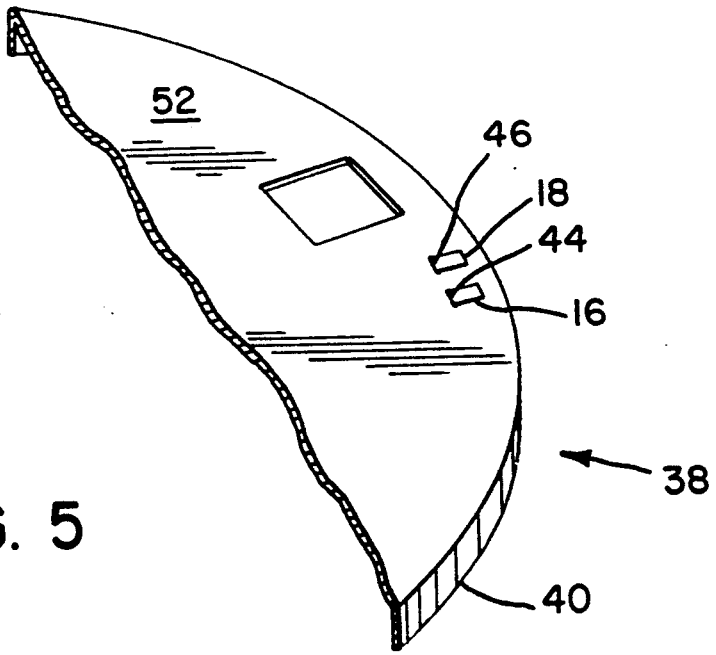
FIG. 5 is a perspective view of the under surface of a bottom pan of a water heater, having an electrical bonding clip of FIG. 1 mounted thereto.

FIGS. 4 and 5 show bonding clip 10 connected to a water heater bottom pan 38. Bottom pan 38 includes a sidewall 40 and a floor 42. Bonding clip 10 has its feet 16 and 18 (FIG. 5) extending through holes 44 and 46 in the floor 42 of bottom pan 38. The top surfaces 48 and 50 of feet 16 and 18 respectively engage the undersurface 52 of floor 42. Similarly, the undersurface of foot 14 is supported upon the top surface 54 of floor 42 (FIG. 4). Bonding clip 10 may be secured to the bottom pan 38 near the end of foot portion by a weld 49.

Figure 6:
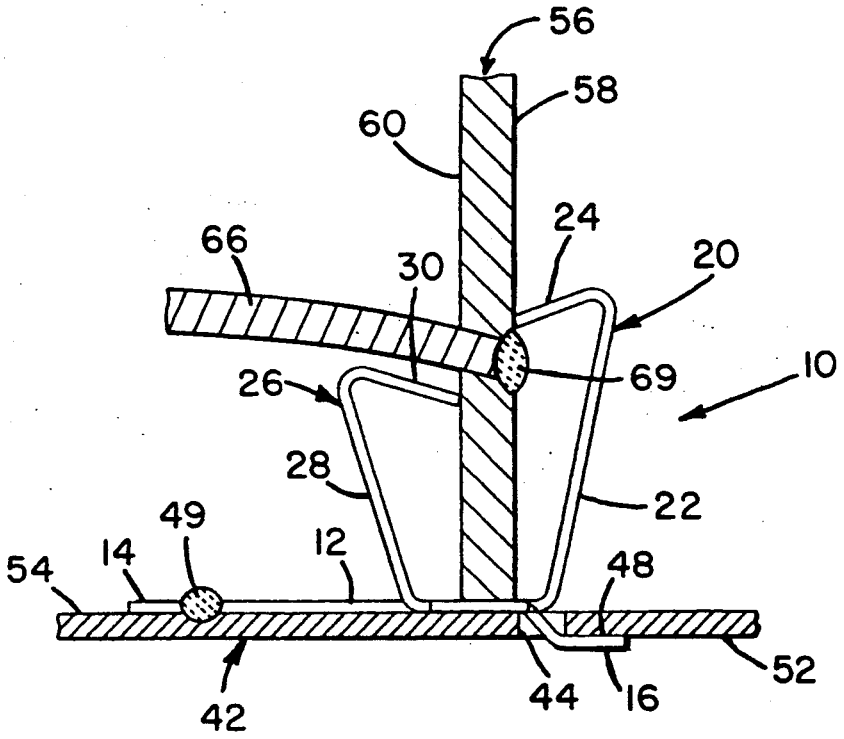
FIG. 6 is a side elevational view of a lower portion of a water heater having an electrical bonding clip of the invention connected to a bottom pan and water tank lower edge, all taken in section, of a water heater.

FIG. 6 illustrates attachment of bonding clip 10 to the floor 42 of bottom pan 38 by the weld 49 and its spring - urged connection to the water tank sidewall 56. Foot 16 extends through hole 44 such that top surface 48 contacts undersurface 52 of floor 42. Undersurface 15 (see FIG. 3) of foot 14 contacts top surface 54 of floor 42. Although not visible in FIG. 6, foot 18 which is directly behind foot 16 extends through hole 46 in a like manner.

Sidewall 56 of the water tank extends substantially vertically upwardly from a rest position on base plate 12 and is positioned between first prong 20 on the one hand and second and third prong 26 and 32, on the other hand. First contact 24 contacts and grips outer surface 58 of sidewall 56 under pressure, while spaced-apart contacts 30 and 36 contact the inner surface 60 of sidewall 56 under pressure. When at rest the spacing between tips 24,30, and 36 is less than the thickness of tank wall 58, the insertion of which forces the clips 20, 26 and 32 to separate to make a spring - urged pressure-tight electrical connection to the water tank wall 58. Preferably the contacts have sharp corners capable of digging into the metal of the tank wall to assure reliable electrical contact throughout the life of the water heater.

As shown, the water tank bottom 66 is welded at 69 to the sidewall 56 and the contact 24 is spring - urged against the weld 69 or just above it.

Figure 7:
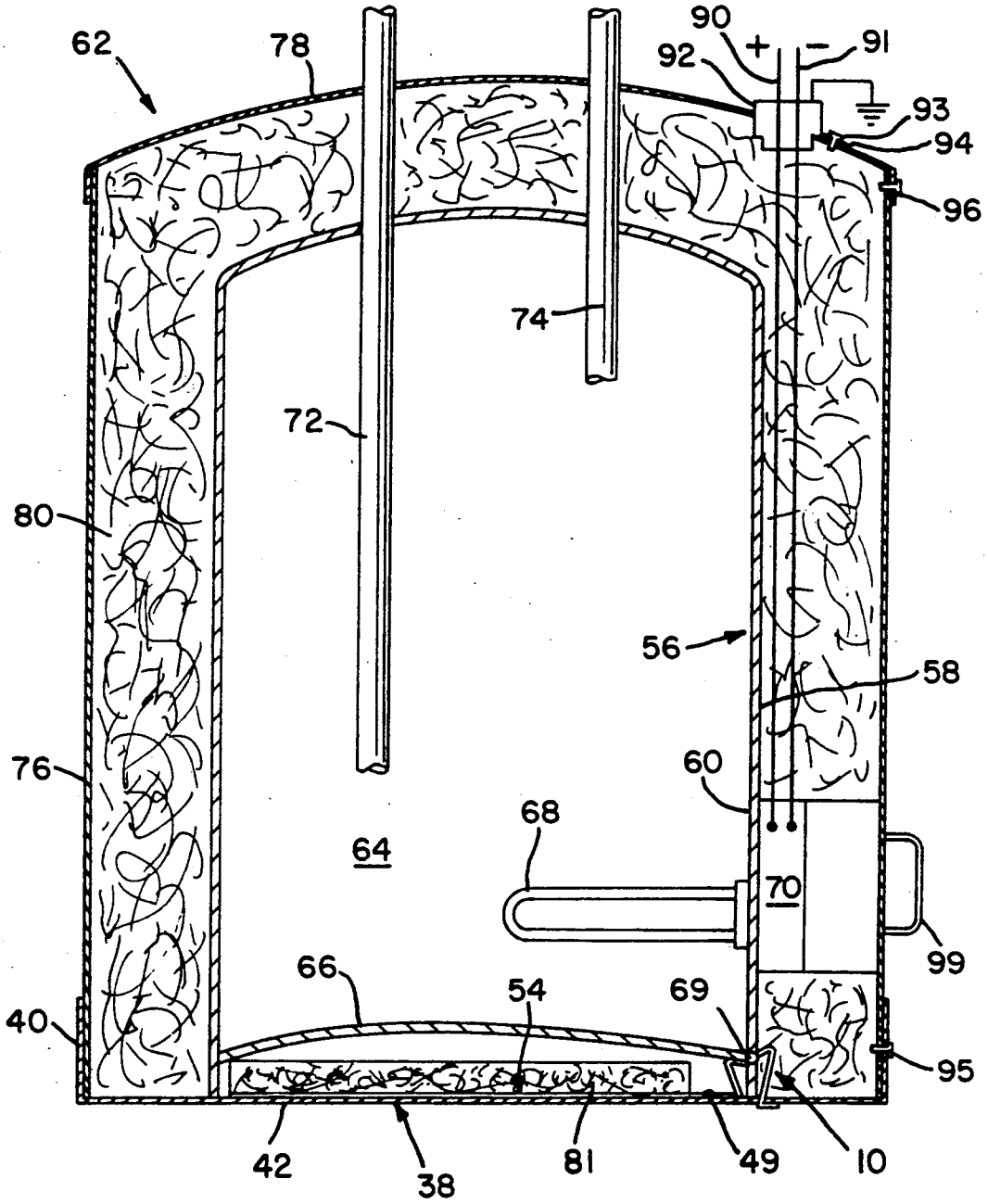
FIG. 7 is a schematic view, with parts taken in section, of a water heater having an electrical bonding clip embodying features of this invention.

FIG. 7 shows one bonding clip 10 in position within a water heater 62. Water heater 62 includes water tank 64 having sidewall 56 and tank bottom 66, heater 68 connected to sidewall 56, heater control mechanism 70 attached to heater 68 and located on sidewall 56 and access door 99. Water heater 62 also includes cold water inlet 72 (part of which is broken away for convenience of illustration) and heated water outlet 74 (part of which is also broken away). Water tank 64 rests on floor 42 of bottom pan 38. Sidewall 40 of bottom pan 38 is screwed by screws 95 to outer jacket 76 at the bottom of water heater 64 and top pan 78 is screwed by screws 96 to outer jacket 76 at the top of water heater 72. Foam insulation 80 is introduced between water tank 64 and outer jacket 76. Fiberglass insulation 81 lies between floor 42 of bottom pan 38 and tank bottom 66 of water tank 64.

The grounding circuit of FIG. 7 will now be apparent. Electric wires 90, 91 extend through a grounding bracket 92 grounded to the top pan 78 of the water heater by a metal screw 93 extending through a tab 94. The wires 90 and 91 extend to the control 70 and are connected to the heating coil 68 to heat the water in the tank 64. The tank 64 is connected to ground by the bonding clip 10 by way of the bottom pan 42 which is grounded to the outer jacket 76 by one or a multiplicity of metal screws 95, which outer jacket 76 in turn is grounded to the top pan 78 by one or a mulitiplicity of metal screws 96. The top pan is, as previously discussed, connected to ground by the grounding bracket 92.

The nature and structure of the novel grounded water heater of this invention will be further understood with respect to the manner in which it may be made. A bottom pan 38 having a substantially solid floor 54 is provided with a pair of holes 44 and 46 (FIG. 5). Feet 16 and 18 of clip 10 are then inserted into and through the holes 44 and 46, respectively and clip 10 is rotated so that foot 14 rotates into contact with the top surface 54 of floor 42. It is then preferably welded in a predetermined position by the weld 49.

Fiberglass or other insulation material 81 (FIG. 7) is then placed onto top surface 54 of floor 42. Fiberglass material 81 is typically essentially of the same diameter as bottom pan 38, such that it fits snugly within sidewall 40. Fiberglass insulation 81 provides an insulating effect between the bottom plate 66 of tank 64 and the bottom pan 38.

In assembling the water heater, bottom pan 38 may be laid flat on a moving assembly line and water tank 64 positioned directly above it. Water tank 64 is then lowered onto bottom pan 38 by engaging both surfaces of sidewall 56 of water tank 64 with clip 10. The thickness of water tank wall 56 coacts with the angular relations of the legs and contacts and forces the prongs 26 and 32 away from prongs 22; the downward inclinations of contacts 24,30 and 36 provide sideward force components forcing such separation. Water tank 64 is lowered in a proper position when the lowermost portion of sidewall 56 contacts and engages the top surface of base plate 12 and the prong edges 24,30 and 36 are tightly spring - urged against, and preferably dug into, the tank wall.

Outer jacket 76 is then lowered onto bottom pan 38, as in FIG. 7, and into engagement with sidewall 40. Bottom pan 38 and outer jacket 76 are, as mentioned, fixed to one another by a plurality of spaced-apart conductive metal screws 95.

After outer jacket 76 is secured to bottom pan 38 and water tank 64 is concentrically positioned with respect to outer jacket 76, foam forming materials are introduced into the annular space between outer jacket 76 and water tank 64. It is possible to utilize foaming aprons, such as disclosed in U.S. Pat. No. 4,808,356, to protect electrical or other components and still achieve optimal flow and coverage of the foam forming materials as they are introduced to the intervening space.

Preferably while the foam forming materials are expanding and flowing into the space, top pan 78 of water heater 62 is then lowered into place over outer jacket 76 and fixed thereto by a plurality of spaced-apart electically conductive metal screws 96. It is, however, possible in the alternative to place top cover 62 over outer jacket 76 followed by introduction of foam forming materials through a foaming hole (not shown).

Utilization of a spring - urged electrical bonding clip of this invention insures that the water heater can be manufactured uniformly and at reduced cost, and that it will operate in a safe and efficient manner. The invention further provides the advantage that these excellent results can be achieved with ease notwithstanding the numerous time demands applied on a rapidly moving assembly line. No extra production personnel and no extra apparatus or assembly line welding steps, or extra screws, wires, cardboard tubing and the like are needed.

Although this invention has been described in connection with specific forms thereof, it will be appreciated that a wide variety of equivalents may be substituted for the specific elements shown and described herein without departing from the spirit and scope of this invention as described in the appended claims. While particular reference has been made to electrically energized water heaters, the invention applies to any water heaters the controls of which are connected to an electrical supply.

The bottom of the water tank may have various shapes, either with a lower sidewall 56 as shown in the drawings or with other lower portions or edges suitable for tight electrical and mechanical engagement with an electrical bonding clip embodying features of this invention. Various other modifications may be made, including the use of a variety of fiberglass or foam insulating materials, tank insulating or foaming techniques, and the use of jackets, tanks and bottom pans of various designs and shapes. Further, variations may be made in the sequence of the steps of the method of manufacture and in the type and design of additional apparatus features included in the water heater in accordance with this invention, all without departing from the spirit and scope of the invention as defined in the appended claims.

I claim:

1. A water heater having an electrically grounded water tank, which water tank includes an electrically conductive portion, said tank having water inlet and outlet means connected to deliver water to and from the water tank and having heating means connected to the tank for heating water in the tank and control means connected to the heating means for controlling the application of heat to the water;

a bottom member electrically grounded to said outer jacket; and a spring urged electrical bonding clip secured to and electrically connected to said bottom member and directly electrically engaging said water tank electrically conductive portion.

2. The water heater defined in claim 1 wherein said bonding clip includes opposed contacts pressed against opposed portions of said water tank electrically conductive portion.

3. The water heater defined in claim 2 wherein said contacts have leg portions connected to a grounding means base plate connected to said bottom member.

4. The water heater defined in claim 3 wherein said leg portions are integral with said base plate.

5. The water heater defined in claim 3 wherein said leg portions include flexible uprights capable of maintaining spring pressure upon said water tank electrically conductive portion.

6. The water heater defined in claim 3 further including a pair of feet extending from the base plate through a pair of holes in the bottom member and in engagement with an undersurface of the bottom member.

7. The water heater defined in claim 5 wherein one said upright extends upwardly at an angle of about 78° from the bottom pan, another said upright extends upwardly at an angle of about 73° from said bottom member, and wherein one of said contacts extends downwardly at an angle of about 122° from its upright and another of said contacts extends downwardly at an angle of about 124° from its upright.

8. The water heater defined in claim 2 wherein the bonding clip includes a pair of substantially parallel spaced uprights each carrying a contact that is spring - urged against the same surface of said water tank electrically conductive portion.

9. The water heater defined in claim 8 wherein the first connector is positioned opposite the spaced apart uprights.

10. The water heater defined in claim 2 wherein the first and second connectors engage opposing surfaces of said water tank electrically conductive portion.

11. An electrically grounded water heater comprising:

a bottom pan;

a water tank having a lower portion positioned adjacent the bottom pan;

an outer jacket surrounding the water tank and connected to the bottom pan;

insulation positioned between the tank and the jacket; and grounding means including (1) a first prong including a first leg extending upwardly at an angle from the bottom pan and having a first tip portion extending downwardly at an angle to the first leg, (2) a second prong including a second leg extending upwardly at an angle from the bottom pan opposite the angle of the first prong and having a second tip portion extending downwardly at an angle to the second leg and (3) a third prong including a third leg extending upwardly at an angle from the bottom pan opposite the angle of the first prong, having a third tip portion extending downwardly at an angle to the third leg and being laterally spaced from the second prong, the first tip portion engaging one side of the water tank lower edge and the second and third tip portions engaging an opposite side of the water tank lower edge.

12. The water heater defined in claim 11 wherein the first and second prongs have proximal ends connected to a base plate connected to the bottom pan.

13. The water heater defined in claim 12 wherein the proximal ends are integral with the base plate.

14. The water heater defined in claim 12 further including a pair of feet extending from the base plate through a pair of holes in the bottom pan and into engagement with an undersurface of the bottom pan.

15. The water heater defined in claim 11 wherein the first leg extends upwardly at an angle of about 78° from the bottom pan, the second leg extends upwardly at an angle of about 73° from the bottom pan, the third leg extends upwardly at an angle of about 73° the first tip portion extends downwardly at an angle of about 122° from the first leg, the second tip portion extends downwardly at an angle of about 124° from the second leg and the third tip portion extends downwardly at an angle of about 124° from the third leg.

16. In a method of producing a water heater which includes a water tank having an electrical connecting portion and a grounded bottom member, the steps comprising:

(a) providing an electrically conductive grounding clip on said bottom member, (b) physically and electrically engaging the water tank electrical connecting portion with said grounding clip, thereby positioning the water tank and the bottom member into position relative to one another and establishing a grounding connection therebetween; and (c) positioning an outer jacket around the water tank and into physical and electrical engagement with said bottom pan, thereby providing a space between the water tank and the jacket and grounding said tank to said jacket through said bottom member 17. The method defined in claim 16 further comprising forming a pair of holes in the bottom pa and inserting feet extending from the grounding clip into the holes to connect the grounding clip to the bottom pan.

18. The method defined in claim 16 further comprising applying a top cover over the outer jacket and the water tank and grounding the jacket to the top cover.

19. The method defined in claim 17 further comprising engaging a first connector having a first distal end and a second connector having a second distal end of the grounding clip with said electrical connecting portion of said tank.

20. The method defined in claim 19 further comprising engaging the first distal end with one surface of the electrical connecting portion and the second distal end with an opposite surface of said electrical connecting portion.

* * * * *

UNITED STATES PATENT AND TRADEMARK OFFICE

CERTIFICATE OF CORRECTION

PATENT NO. : 5,081,696

DATED : January 14, 1992

INVENTOR(S) : David H. Beck

It is certified that error appears in the above-identified patent and that said Letters Patent is hereby corrected as shown below:

Column 1, line 4, after "grounded" insert --water--.

Column 1, lines 31 and 32, delete the phrase "While the resulting electrical grounding connection is often".

Column 5, line 64, after "water;" insert the following paragraph --an electrically grounded outer jacket surrounding said water tank;--.

Column 8, line 10, please change "pa" to --pan--.

Signed and Sealed this

Twentieth Day of April, 1993

*Attest:*

MICHAEL K. KIRK

*Attesting Officer*

*Acting Commissioner of Patents and Trademarks*